US007062146B2

(12) United States Patent
Elias et al.

(10) Patent No.: US 7,062,146 B2
(45) Date of Patent: Jun. 13, 2006

(54) INTERACTIVE APPARATUS WITH INTERACTIVE ELEMENTS

(75) Inventors: Stephanie Elias, San Francisco, CA (US); Christa McClintock, San Francisco, CA (US); Eric T. Shuler, Piedmont, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 0 days.

(21) Appl. No.: 10/965,708

(22) Filed: Oct. 13, 2004

(65) Prior Publication Data

US 2005/0094962 A1 May 5, 2005

Related U.S. Application Data

(60) Provisional application No. 60/511,811, filed on Oct. 15, 2003.

(51) Int. Cl.
*G02B 6/00* (2006.01)

(52) U.S. Cl. ..... 385/147; 297/135

(58) Field of Classification Search ..... 385/147; 297/135–138, 144, 452.12
See application file for complete search history.

(56) References Cited

U.S. PATENT DOCUMENTS 4,627,588 A * 12/1986 Block ..... 248/163.2
5,187,826 A * 2/1993 Mariol ..... 5/655
5,478,268 A * 12/1995 Au ..... 446/227
5,575,530 A 11/1996 Harper et al.
5,863,097 A 1/1999 Harper et al.
6,113,455 A * 9/2000 Whelan et al. ..... 446/227
6,257,659 B1 7/2001 Wilkins et al.
6,390,555 B1 5/2002 Wilkins et al.
6,592,425 B1 * 7/2003 Bapst et al. ..... 446/227
6,629,727 B1 * 10/2003 Asbach et al. ..... 297/188.21
2001/0015569 A1 8/2001 Wilkins et al.
2002/0002741 A1 * 1/2002 Tomas et al. ..... 5/101
2003/0020317 A1 1/2003 Keegan et al.
2003/0057744 A1 3/2003 Wilkins et al.
2005/0054486 A1 * 3/2005 Turner et al. ..... 482/27

OTHER PUBLICATIONS

*Ocean Wonders-Aquarium Bouncer Manuel*, Model 79030 2002.

* cited by examiner

*Primary Examiner*—Ellen E. Kim
(74) *Attorney, Agent, or Firm*—Townsend and Townsend and Crew LLP

(57) ABSTRACT

An interactive apparatus including a reflective member is disclosed. The reflective member includes a first image and a second image, wherein the reflective member is at least partially reflective. The apparatus also includes a first element coupled to a first sensor, the first sensor being activated by the first element, and a second element coupled to a second sensor, the second sensor being activated by the second element. Activation of the first sensor causes the first image to appear in the reflective member at a first location and activation of the second sensor causes the second image to appear in the reflective member at a second location.

4 Claims, 15 Drawing Sheets

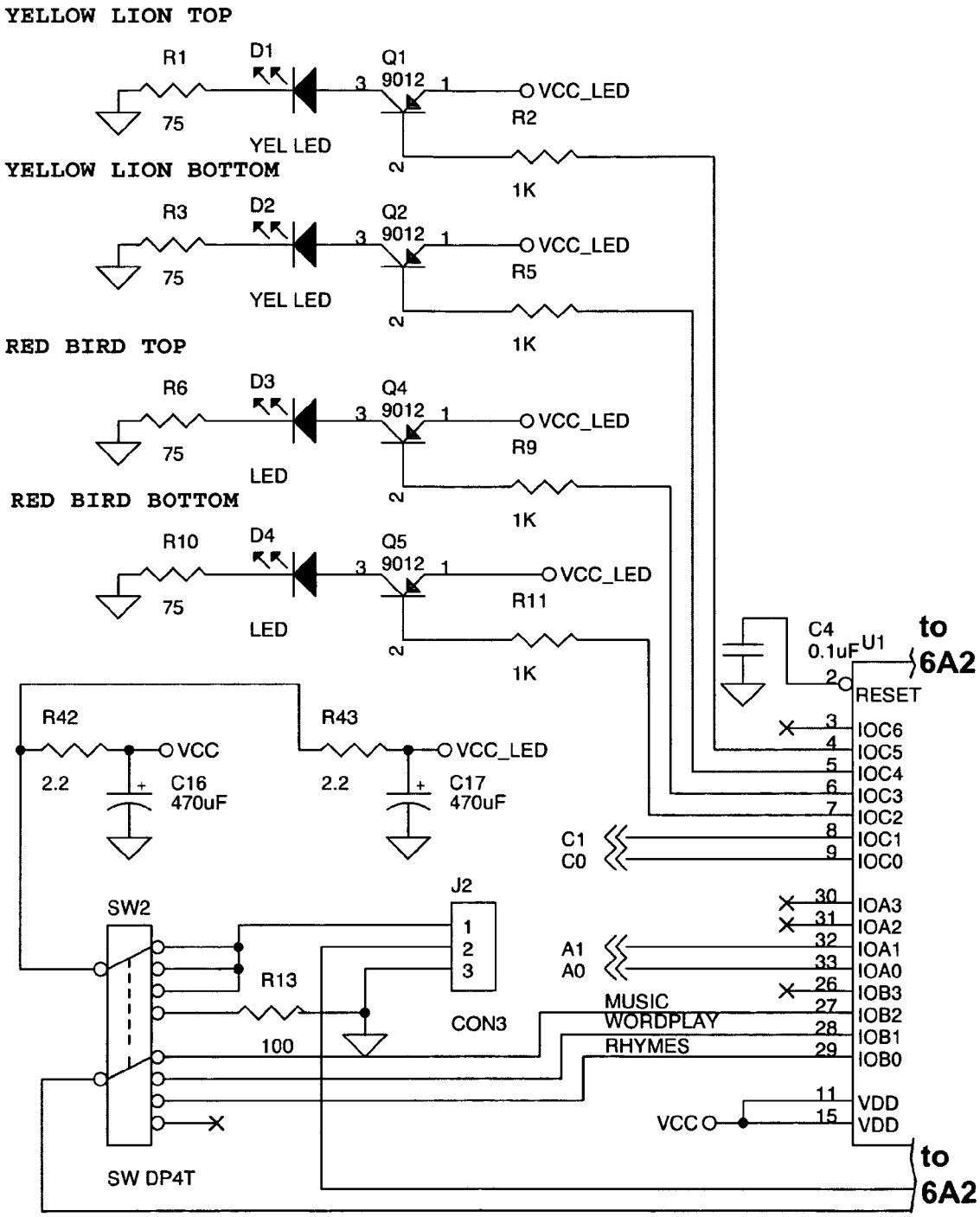
FIG. 6A1

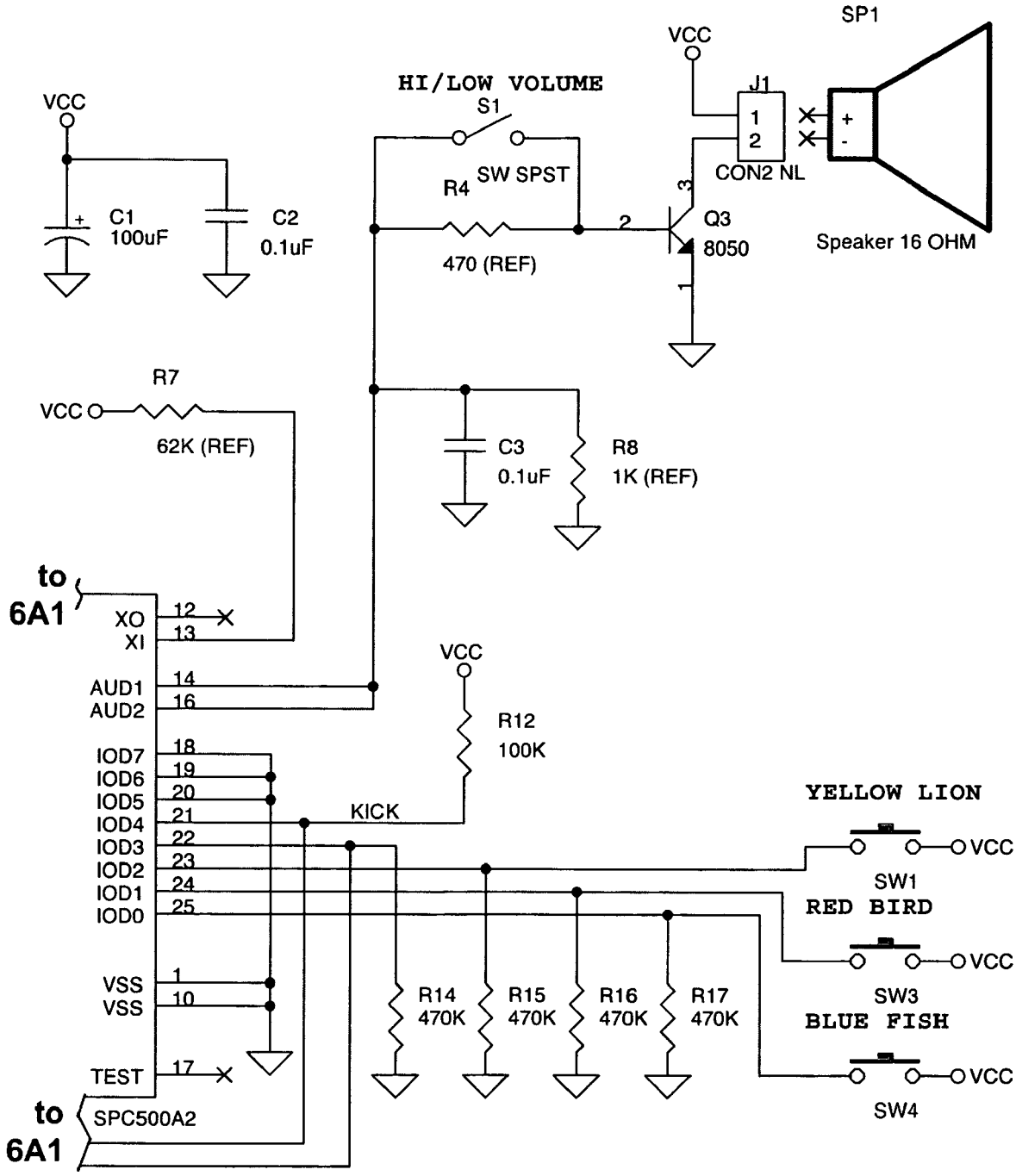
FIG. 6A2

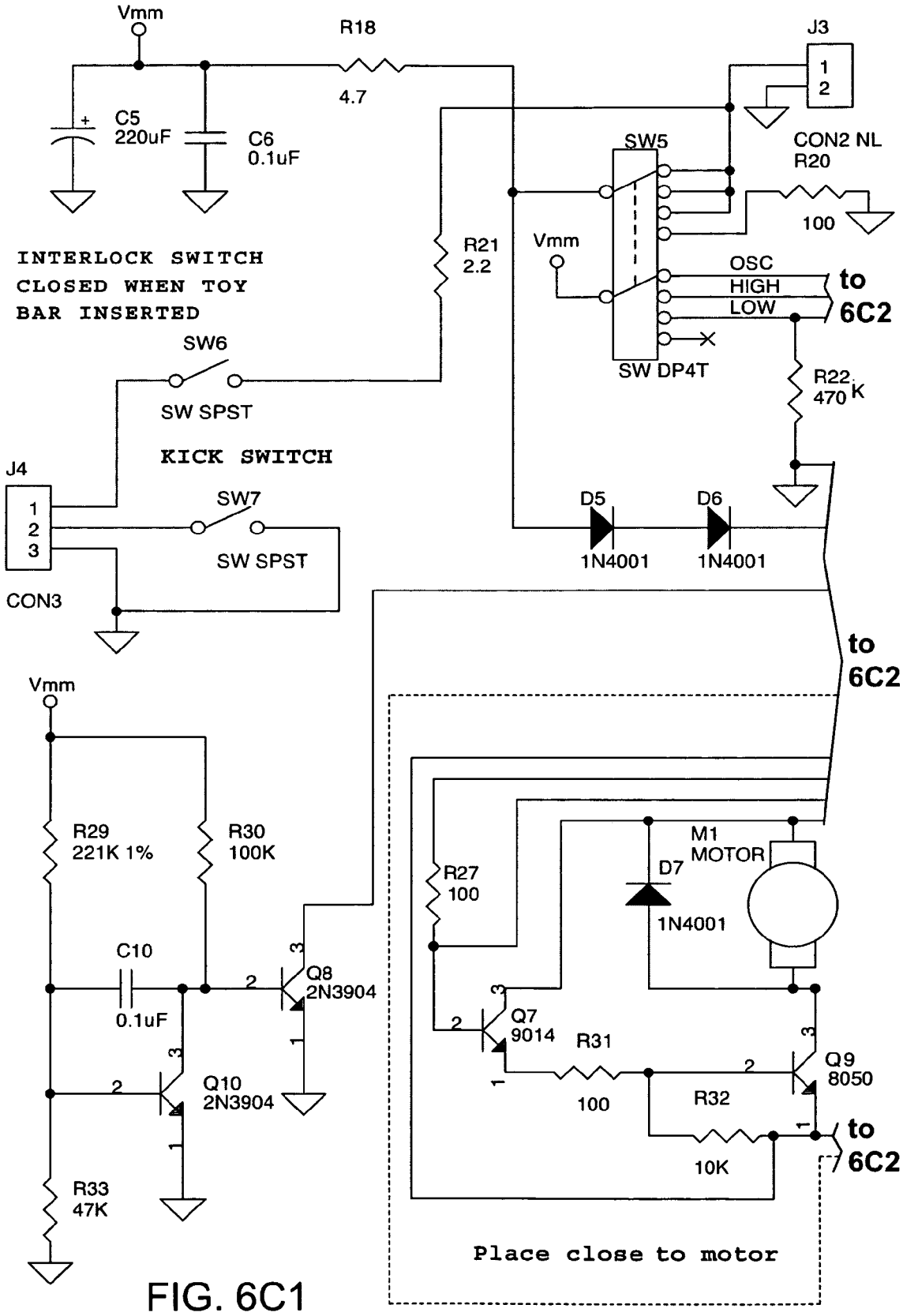
FIG. 6C1

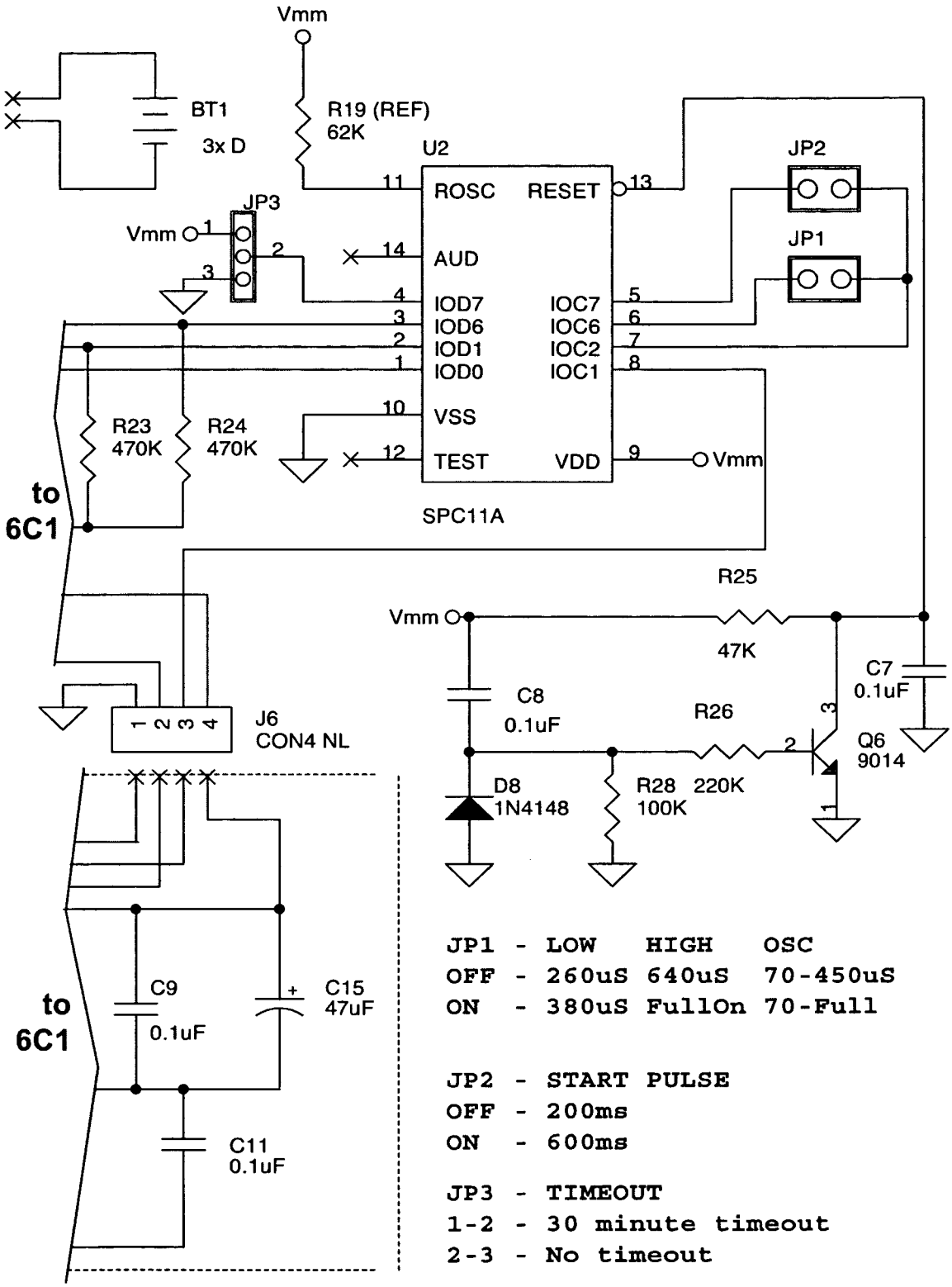
FIG. 6C2

INTERACTIVE APPARATUS WITH INTERACTIVE ELEMENTS

CROSS-REFERENCES TO RELATED APPLICATIONS

This application is a non-provisional application of and claims the benefit of priority of U.S. Provisional Application No. 60/511,811, filed on Oct. 15, 2003, which, under 37 C.F.R. §1.78(a)(5), is herein incorporated by reference in its entirety for all purposes.

BACKGROUND OF THE INVENTION

Infant bouncer seats are well known in the art. One type of infant seat is disclosed in U.S. Pat. No. 5,187,826 to Mariol, which discloses an infant seat including a continuous wire frame which is bent to form a support base and angles upward to form a U-shaped loop that supports an upper portion of a fabric seat. The curve of the wire frame between the support base and the loop acts as a torsion spring, permitting the seat to "bounce" relative to the support base. Such an infant seat typically includes a seat-belt or strap that is fastened around the infant after the infant is placed in the seat.

Moreover, infant seats may contain a toy bar attached to the infant seat as illustrated by FIG. 1 of Mariol. In some infant seats, the toy bar is removable. Typically, the toy bar will have several toys, animal figures, or rotating objects either attached to or suspended from the horizontal portion of the toy bar. In some cases, objects suspended from the toy bar are free to swing in one or more directions. If the toys are located within reach of an infant placed in the seat, they can serve to provide stimulation and entertainment to the infant as the infant bats and grabs the toys.

Although these infant seats have been known in the art, improvements could be made. For example, although parents are warned to only place the infant seats on the floor or ground and not on raised surfaces, such as tables, this warning is most likely disregarded in some cases. Unfortunately, placing the infant seat on a raised surface can create a dangerous situation in which an infant bouncing in the seat may cause the seat to move toward and subsequently over an edge of the raised surface, thereby possibly falling and injuring the infant. Infant seats with improved stability would be desirable. Moreover, the toy bars used on prior infant seats provide only limited educational and entertainment options for an infant. Therefore, there is a need in the art for improved infant seats that address these shortcomings. There is also a need to provide for more interactive apparatuses that are fun, engaging, and educational.

Embodiments of the invention address these and other problems, individually and collectively.

SUMMARY OF THE INVENTION

The present invention relates generally to an interactive apparatus. More particularly, the invention relates to an apparatus including an interactive optical/audio device and methods of using such an apparatus. Merely by way of example, the invention has been applied to an infant bouncer seat with an interactive apparatus including a reflective member, a number of optical emitters arranged to backlight images disposed on the reflective member, and input devices adapted to initiate optical and audio sequences. These method and apparatus can be applied to other apparatus that include the interactive apparatus, such as a stroller, car seat, crib, the LeapStart™ Gym manufactured by LeapFrog as well as other apparatus manufactured by LeapFrog or others.

In one embodiment, the invention is directed to an interactive apparatus comprising a reflective member including a first image and a second image, wherein the reflective member is at least partially reflective. In this embodiment, a first element is coupled to a first sensor, the first sensor being activated by the first element, and a second element is coupled to a second sensor, the second sensor being activated by the second element. Activation of the first sensor causes the first image to appear in the reflective member at a first location and activation of the second sensor causes the second image to appear in the reflective member at a second location.

Another embodiment of the invention is directed to an interactive device further comprising a first optical emitter and a second optical emitter. Activation of the first sensor causes the first optical emitter to emit visible radiation centered at a first wavelength value and activation of the second sensor causes the second optical emitter to emit visible radiation centered at a second wavelength value. In a particular embodiment, the first optical emitter is a first light emitting diode and the second optical emitter is a second light emitting diode. A specific embodiment of the invention further includes a support member, wherein the first optical emitter is mounted on the support member at a first position, the first position being in optical communication with the first location, and wherein the second optical emitter is mounted on the support member at a second position, the second position being in optical communication with the second location.

Another specific embodiment of the invention is directed to an infant bouncer seat. The infant bouncer seat includes a seat inclined at a predetermined angle with respect to the horizontal and is adapted to support an infant in a semi-reclined position. The infant bouncer seat further includes an interactive mirror comprising a first image and a second image, a first tactile element coupled to the interactive mirror, and a second tactile element coupled to the interactive mirror. In a specific embodiment, the first tactile element and the second tactile element are positioned within arms reach of an infant supported in a semi-reclined position by the seat.

Yet another embodiment of the invention is directed to an interactive optical device comprising a control circuit, a reflective member comprising reflective and opaque regions, along with a front surface and a back surface, and a support member coupled to the back surface of the reflective member. The interactive optical device also includes a first optical emitter coupled to the support member, disposed behind the back surface of the reflective member, and electrically coupled to the control circuit, an audio device electrically coupled to the control circuit, and a sensor electrically coupled to the control circuit. The interactive optical device further includes an input device mechanically coupled to the sensor, wherein motion of the input device produces activation of the sensor and causes the control circuit to initiate: emission of visible radiation from the first optical emitter, a portion of the emission being transmitted through the front surface of the reflective member, and generation of sound from the audio device.

These and other embodiments of the invention are described in further detail below.

BRIEF DESCRIPTION OF THE DRAWINGS

FIGS. 6A–6C are schematic diagrams of an electrical circuit for an interactive apparatus according to an embodiment of the present invention.

DESCRIPTION OF SPECIFIC EMBODIMENTS

The present invention generally provides an interactive apparatus. More particularly, the invention provides an apparatus including an interactive optical/audio device and methods of using such an apparatus.

Figure 1:
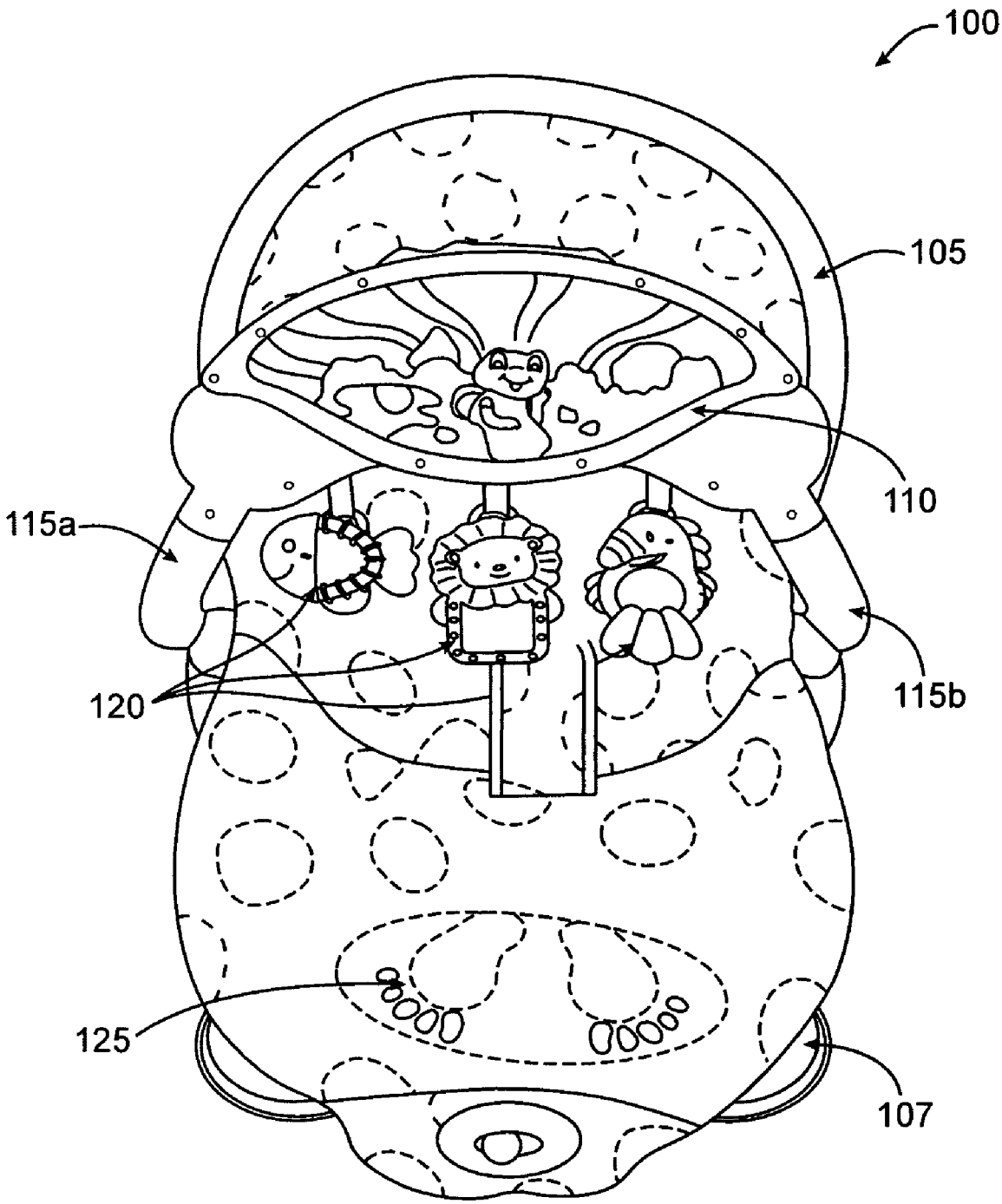
FIG. 1 is a simplified illustration of an infant bouncer seat according to an embodiment of the present invention.

FIG. 1 is a simplified illustration of an infant bouncer seat according to an embodiment of the present invention. In the illustrated embodiment, the infant bouncer 100 includes a seat 105, which reclines at a pre-determined angle with respect to the horizontal. In a specific embodiment, the seat reclines at an angle of approximately 30° with respect to the horizontal and supports an infant weighing up to about 25 pounds. Seat 105 is covered with a padded cloth fabric which is printed with various designs and shapes in multiple colors. The infant bouncer seat is supported by a base comprising a dome-shaped base member (not shown) coupled to four dome-shaped support members 107. Additional details regarding the base are discussed later in relation to FIGS. 5A and 5B.

Interactive apparatus 110 is supported by support arms 115*a* and 115*b*, which are, in turn, supported by extensions from the base. In embodiments of the present invention, a number of elements are coupled to the interactive apparatus. In the embodiment illustrated in FIG. 1, three tactile elements 120 are suspended below interactive apparatus 110. As illustrated in FIG. 1, one embodiment includes three elements 120 that are colored plastic toys generally shaped to represent animals. Although the three elements illustrated in FIG. 1 are made out of plastic, this is not required by the present invention. In other embodiments, at least one of the elements is a plush toy made using pongee fabric with embroidered facial features. In alternative embodiments, at least one of the elements is made using brushed tricot and includes a phylate free teething ring.

Pad 125 is positioned near the lower portion of seat 105 so that an infant's feet generally come in contact with the pad. A sensor (not shown) is mounted below the pad 125. In an embodiment of the present invention, the sensor is a kick-pad sensor and is activated by an infant positioned in the seat making a backward kicking motion with the feet.

Figure 2:
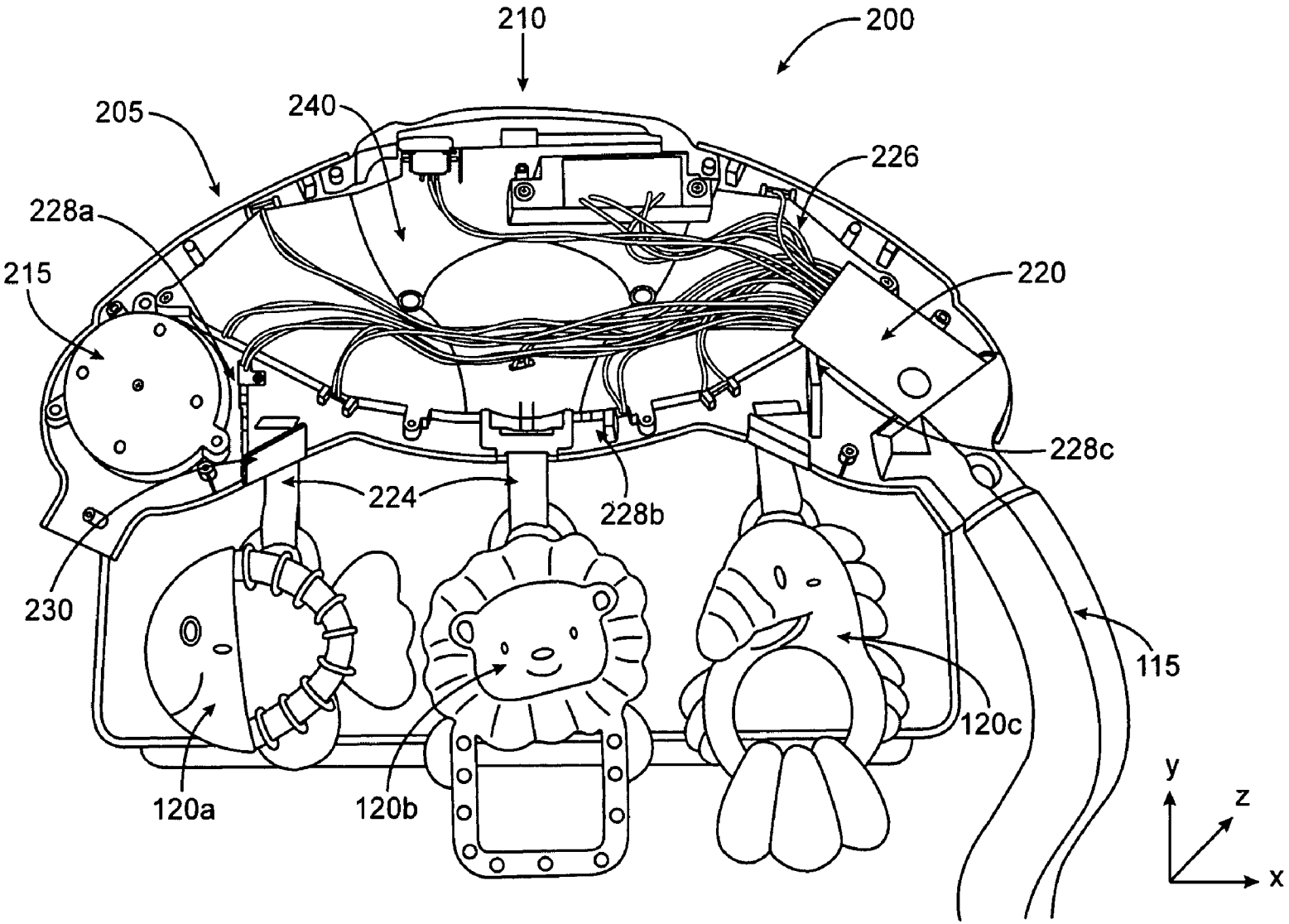
FIG. 2 is a simplified illustration of some components of an interactive apparatus according to an embodiment of the present invention.

FIG. 2 is a simplified illustration of some components of an interactive apparatus according to an embodiment of the present invention. Interactive apparatus 200 includes housing 205 coupled to control circuitry 220. Support member 240 is coupled to housing 205 and provides support for wiring 226, along with other structures, as will be described more fully below. As illustrated in FIG. 2, the interactive apparatus also includes a control module 210 electrically coupled to the control circuitry 220 through wires 226 and used to control some features of the operation of the interactive apparatus.

In one embodiment, the control module 210 comprises a first toggle switch with multiple positions, including an "OFF" position, a "SONGS & RHYMES" position, a "WORD PLAY" position, and a "CLASSICAL MUSIC" position. Various modes of operation are selected by positioning the first toggle switch at an appropriate position, identified by corresponding symbols on the interactive apparatus. For example, when the first toggle switch is positioned at the "CLASSICAL MUSIC" position, activation of the interactive apparatus will result in selections of classical music being played by the interactive apparatus. In another embodiment, a second toggle switch comprises a "LOW" and a "HIGH" volume setting. In a particular embodiment, both the first and second toggle switches are present on the control module, providing for both selection of operating mode and volume control.

As illustrated in FIG. 2, audio speaker 215 is mounted on housing 205. In one embodiment, the audio speaker is a 2.25 inch, paper cone, 16 ohm speaker. In the embodiment illustrated in FIG. 2, the speaker 215 is electrically coupled to control circuitry 220 through wires 226.

Elements 120 are attached to housing 205 through the use of fasteners 224. In a particular embodiment, the elements represent a blue fish (element 120*a*), a yellow lion (element 120*b*), and a red parrot (element 120*c*). The elements are suspended from the interactive apparatus through the use of fasteners connected to upper portions of the elements 210 on one end and fastener supports 230 located inside the interactive apparatus on the other end.

In the embodiment illustrated in FIG. 2, the fasteners are made out of strips of colored fabric. The fabric is looped through an opening in an upper portion of elements 120, sewn together along a portion of the length of the fabric strip, and passed through a central opening in the bottom of the fastener support 230. A tab, which is used to attach the fastener to the fastener support, is formed by sewing a plastic insert into the fastener at the end of the fastener passing through the fastener support. Other methods of attaching the elements 120 to the housing will be evident to one of skill in the art.

The fastener supports are located adjacent to and mechanically coupled to sensors 228, (e.g., electrical switches) which are mechanically connected to housing 205 and electrical coupled to control circuitry 220. In the embodiment illustrated in FIG. 2, the sensors are leaf switches. As illustrated in FIG. 2, the leaf switches are activated by flexure in the z-direction. Fastener supports 230 possess a limited range of rotational motion around the x-axis, along with extension arms extending in the y-direction and positioned on either side of the leaf switches. Thus, in the embodiment illustrated in FIG. 2, sufficient motion of an element 120 in the z-direction produces a rotation of the associated fastener support around the x-axis and contact between the extension arms of the associated fastener support and sensor, thus resulting in activation of the sensor. As illustrated in FIG. 2, one embodiment of the present invention utilizes one sensor for each tactile element; sensor 228*a* activated by element 120*a*, sensor 228*b* activated by element 120*b*, and sensor 228*c* activated by element 120*c*. As will be discussed more fully below, sensors 228 are electrically coupled to control circuitry 220. Thus, activation of the sensors by motion of the elements results in electrical signals being generated and distributed to various optical and audio devices.

In one embodiment of the present invention, elements 120 comprise an annular structure integrated into the body of the element. For example, the element 120*b* in the general shape of a lion (as illustrated in FIG. 2) includes a square opening forming the bottom portion of the element. In other embodiments, annular structures generally shaped as triangles (element 120*a*) or circles (element 120*c*) are utilized as structural features in the elements. Merely by way of example, these opening are adapted to be used for grasping by an infant's hands or fingers. Although each of the elements illustrated in FIG. 2 comprise an annular structure, this is not required by the present invention. Elements utilizing solid structures or other shapes of annular regions are employed in alternative embodiments. Moreover, in embodiments according to the present invention, elements 120 comprise mirror image structures bonded together. For example, in FIG. 2, the element 120*a* in the general shape of a fish illustrates the left side of the fish-shaped element. In one embodiment, the opposite side of the element (not shown) is the right side of the same fish-shaped element.

Figure 3A:
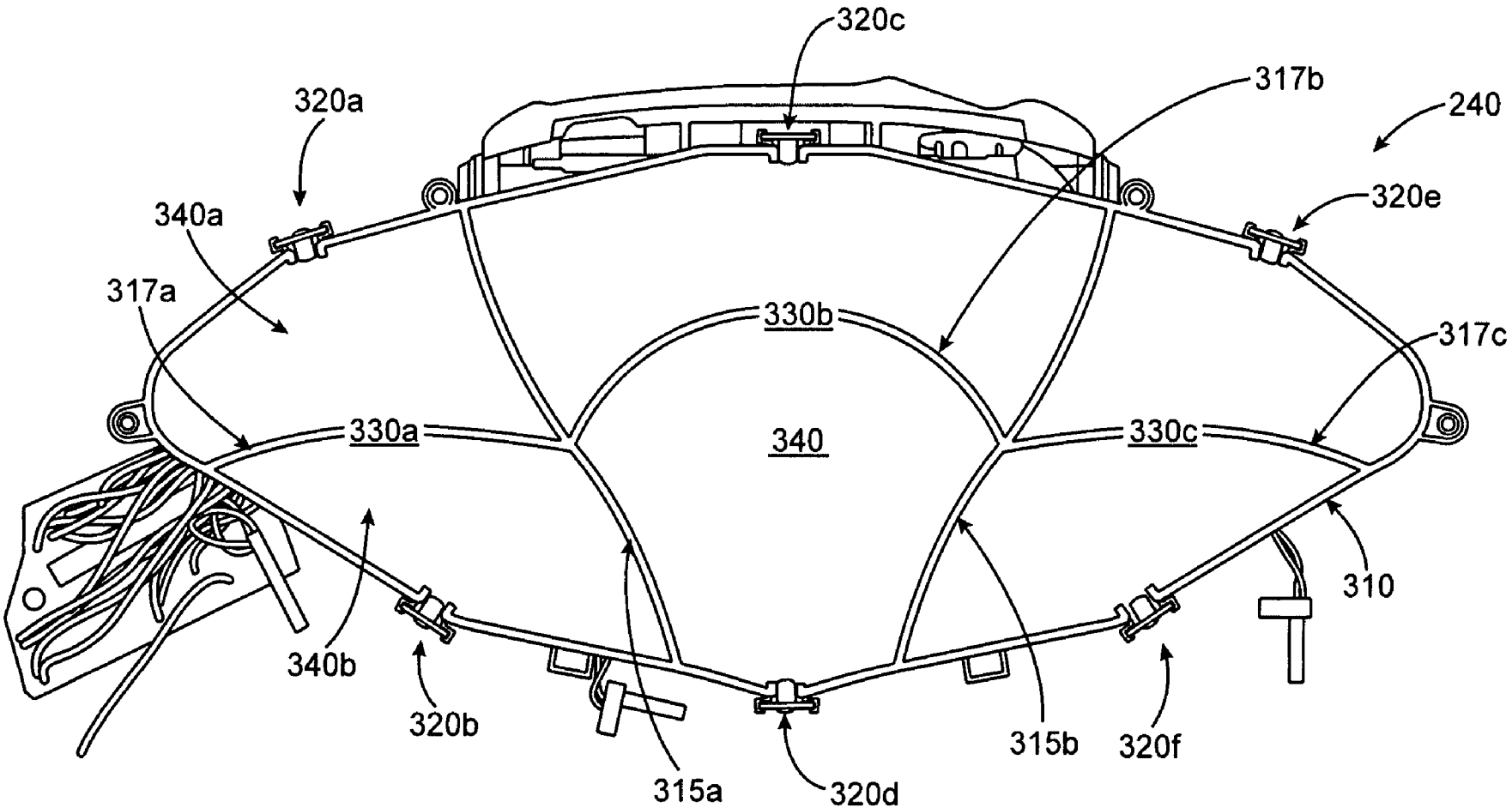
FIG. 3A is a simplified schematic illustration of a support member according to an embodiment of the present invention.

FIG. 3A is a simplified schematic illustration of a support member according to an embodiment of the present invention. As illustrated in FIG. 3A, support member 240 is subdivided into a number of concave chambers 330 by a series of dividing walls 315 and a peripheral wall 310. In the embodiment illustrated in FIG. 3A, two generally vertical dividing walls 315*a* and 315*b* run from a lower portion of the support member, at which edge the dividing walls make contact with the peripheral wall 310, to an upper portion of the support member, where the dividing walls also make contact with the peripheral wall. In one embodiment, the subdivision of the support member by these dividing walls 315*a* and 315*b*, and the peripheral wall 310, produces left, middle, and right chambers, chambers 330*a*, 330*b*, and 330*c*, respectively. For purposes of orientation, the side of support member 240 illustrated in FIG. 3A is referred to as the front side of the support member. Referring back to FIG. 2, the back side of the support member is visible under wires 226.

Moreover, generally horizontal walls 317 further subdivide the support member illustrated in FIG. 3A into additional chambers. The generally horizontal walls 317 run from a left portion of the support member, at which edge the generally horizontal dividing wall makes contact with the peripheral wall 310, to a right portion of the support member, where the generally horizontal dividing wall also makes contact with the peripheral wall. Thus, as illustrated in FIG. 3A, chamber 330*a* is further subdivided by dividing wall 317*a* into an upper left chamber 340*a* and a lower left chamber 340*b*. Although two of the dividing walls 317*a* and 317*b* illustrated in FIG. 3A are generally horizontal and linear, this is not required by the present invention. For example, a dividing wall 317*b* in the shape of an arc subdivides chamber 330*b* into upper and lower chambers. As will be described more fully below, in one embodiment, the shapes and dimensions of the chambers are selected to correlate with graphic patterns and images associated with other structures included in embodiments of the present invention.

A number of optical emitters are mounted at selected locations in the peripheral wall in one embodiment of the present invention. In this embodiment, each of the optical emitters are mounted in optical communication with a selected chamber. As illustrated in FIG. 3A, six optical emitters are mounted with their emission apertures facing toward the interior of the chambers 340. In one embodiment, the radiation emitted by the optical emitters is characterized by a diverging beam pattern. For example, light emitting diodes with a generally cone-shaped beam pattern emit light toward the top and bottom of the chambers 340 and as well as in directions parallel to the plane of the support member. In some embodiments, the support member is made from a material that reflects some portion of the radiation incident on the chambers, thus providing for reflection of light emitted by the optical emitters in the direction of the chamber bottom. Moreover, in alternative embodiments, the support member is made from a material that is a diffuse reflector, both reflecting and scattering light incident on the support member. The optical emitters are electrical coupled to control circuitry 220 (not shown) by wires 226 (not shown).

Figure 3B:
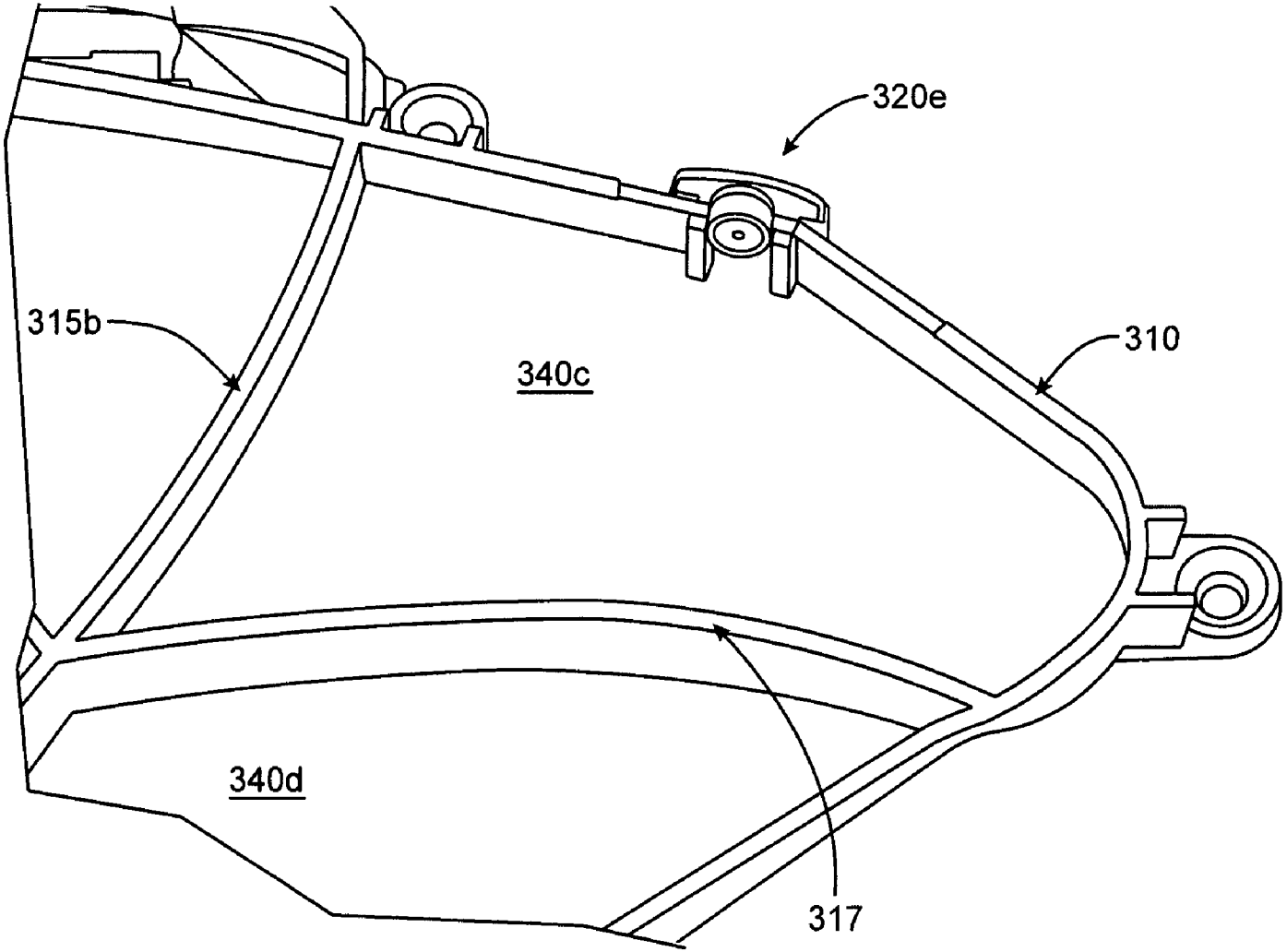
FIG. 3B is a simplified schematic illustration of an upper right portion of a support member according to an embodiment of the present invention

FIG. 3B is a simplified schematic illustration of an upper right portion of a support member according to an embodiment of the present invention. As illustrated in FIG. 3B, upper right chamber 340*c* is defined by generally vertical dividing wall 315*b*, generally horizontal dividing wall 317, and peripheral wall 310. Although the dividing walls illustrated in FIG. 3B are generally linear, this is not required by the present invention. The shapes and dimensions of the particular chambers 340 are selected in some embodiments to correlate with graphic patterns and images associated with other structures included in embodiments of the present invention. Optical emitter 320*e* is mounted in optical communication with chamber 340*c*. In one embodiment, optical emitter 320 is a light emitting diode (LED). In a particular embodiment, optical emitter 320 is a super bright LED of pre-selected wavelength 30 and intensity. For example, in a particular embodiment, a red LED is used as the optical emitter. In alternative embodiments, the optical emitters 320 associated with different chambers have different performance characteristics, including wavelength and intensity. Merely by way of example, in one embodiment, a yellow LED is used as one of the optical emitters and a blue LED is used as one of additional optical emitters.

Referring back to FIG. 3A, in one embodiment, the optical emitters mounted at the upper and lower peripheral edges of chambers 330*a*, 330*b*, and 330*c* are LEDs. In a particular embodiment, the LEDs mounted at the upper and lower peripheral edges of a particular chamber are color coordinated. For example, in one embodiment, LEDs 320*a* and 320*b* are blue LEDs, LEDs 320*c* and 320*d* are yellow LEDs, and LEDs 320*e* and 320*f* are red LEDs. In a specific embodiment, the color of the LEDs is selected to generally match the color of the elements 120 suspended from the interactive apparatus. Thus, in this specific embodiment, blue LEDs 320*a* and 320*b* are color coordinated with blue element 120*a*. In alternative embodiments, yellow LEDs

320*c* and 320*d* are color coordinated with yellow element 120*b*, and red LEDs 320*e* and 320*f* are color coordinated with red element 120*c*.

As illustrated in FIGS. 3A and 3B, individual optical emitters are mounted at a lower or upper edge of chambers 340. In some embodiments, the LEDs are operated independently. For example, red LEDs 320*e* and 320*f* can be controlled by control circuitry 220 to respond to motion of element 120*c* and activation of the associated sensor 228*c*. In an embodiment, LED 320*f* is illuminated when element 120*c* is moved a first time, activating sensor 228*c* a first time. A second movement of element 120*c* within a predetermined time will activate sensor 228*c* a second time, resulting in simultaneous illumination of both LEDs 320*e* and 320*f*. In alternative embodiments, the LEDs are illuminated based on activation of sensors 228 either simultaneously or sequentially for predetermined time periods and in predetermined patterns. In other embodiments, the LEDs are pulsed either sequentially or simultaneously or in a rhythmic manner.

Moreover, in additional embodiments, the LEDs in a particular chamber 340 are illuminated in accordance with signals generated by control circuitry 220. Merely by way of example, in the "CLASSICAL MUSIC" position of operation discussed above, the LEDs 320 are illuminated simultaneously and/or sequentially for pre-determined periods in rhythm with selections of classical music played by the speaker 215. In a particular embodiment, after activation of one of the sensors 228, the musical melodies will be produced by the audio speaker, accompanied by illumination of one or more LEDS in time with the music, for either 5 minutes or until additional inputs are received by the control circuitry.

Figure 4A:
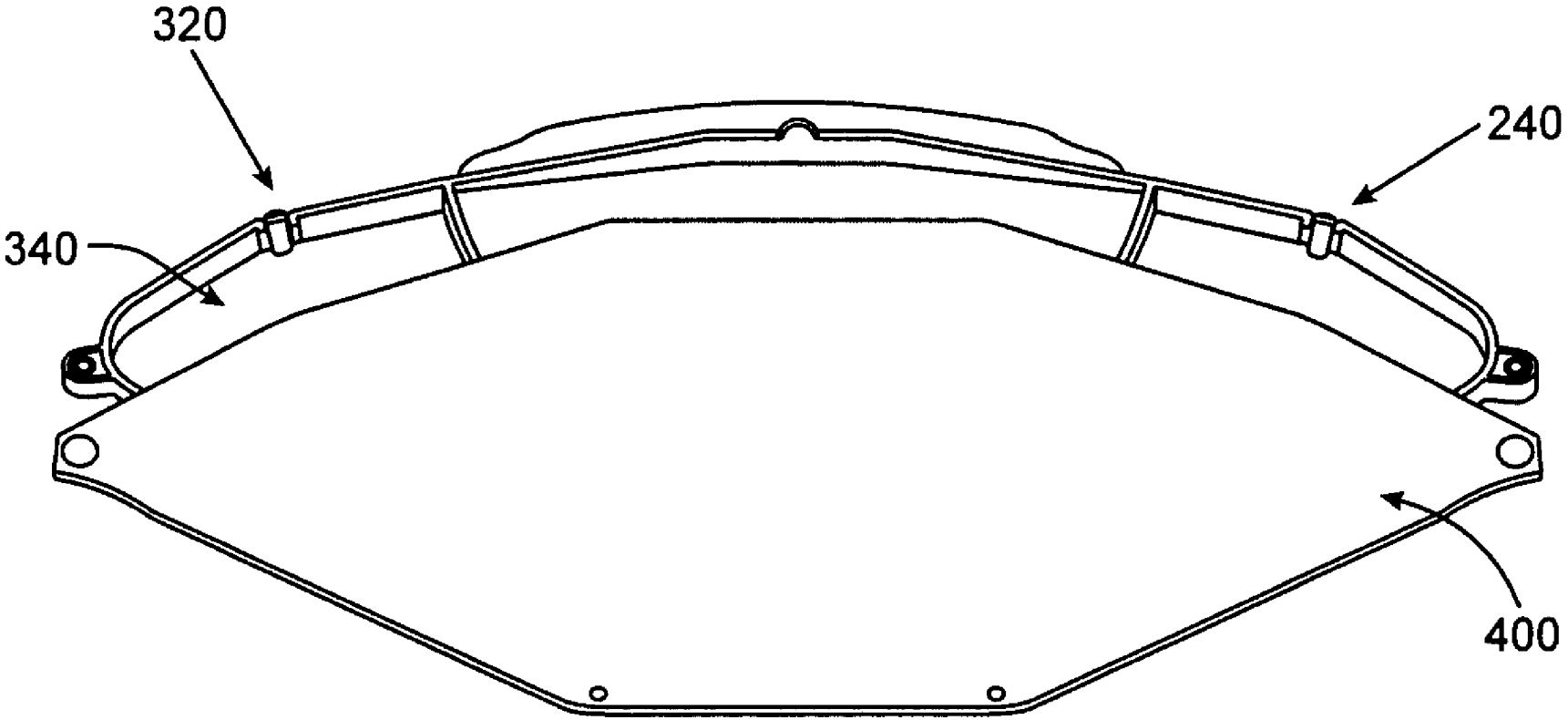
FIG. 4A is a simplified expanded view of a support member and a front view of a reflective member according to an embodiment of the present invention.
Figure 4B:
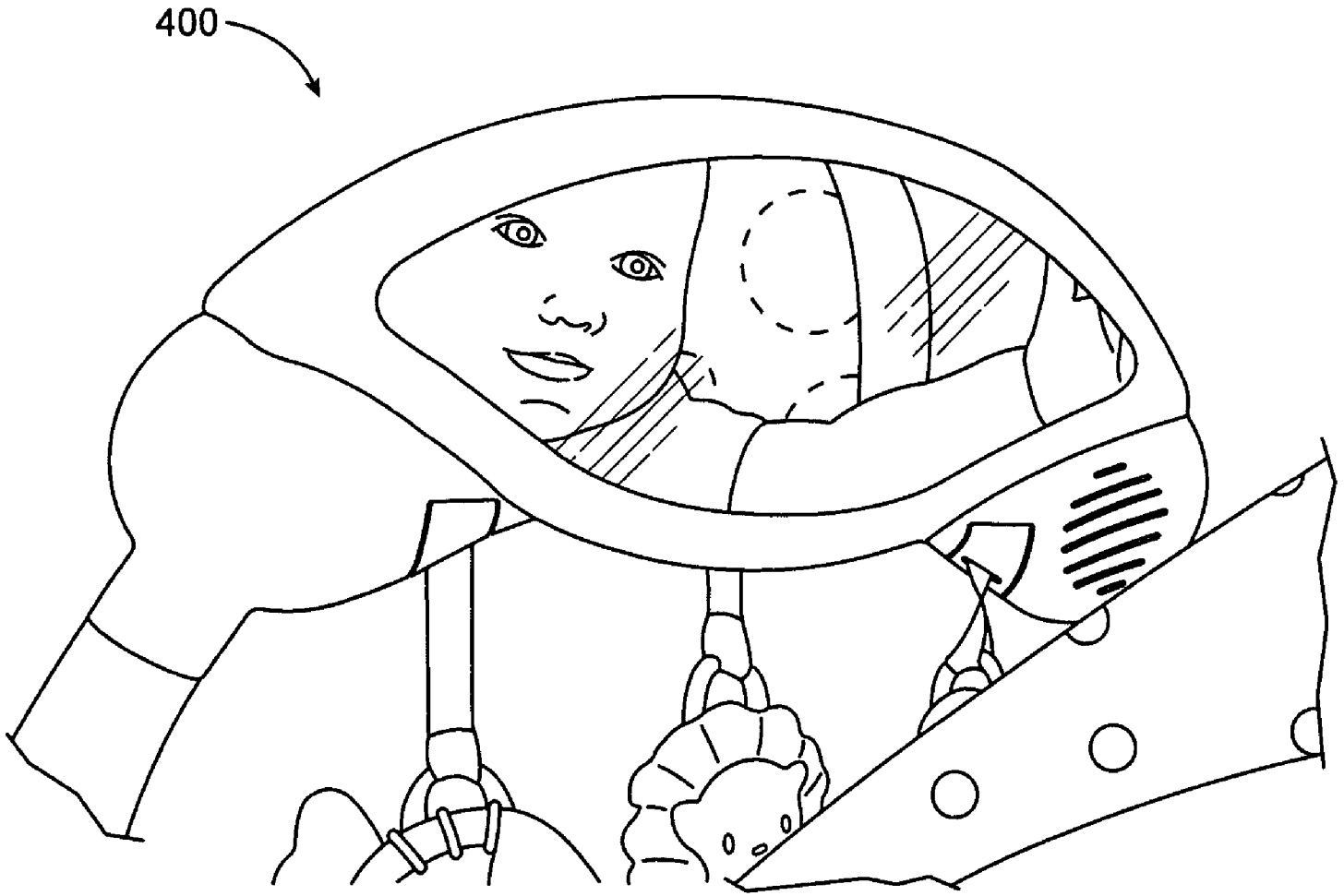
FIG. 4B is a perspective view of a front side of a reflective member, when the sensors are not activated.

FIG. 4A is a simplified expanded view of a support member and a front view of a reflective member according to an embodiment of the present invention. FIG. 4B is a perspective view of a front side of a reflective member, when the sensors are not activated. As illustrated in FIG. 4A, reflective member 400 is mounted adjacent to and in front of the support member 240. In one embodiment, reflective member 400 is at least partially reflective. Thus, in a particular embodiment, a portion of the light incident on a front surface of reflective member 400 (the surface shown in FIGS. 4A and 4B), is reflected from the surface. In this way, the reflective member provides a mirror effect for light incident from the front surface when the sensors are not activated. In this particular embodiment, not only is the reflective member partially reflective, it is also characterized by a low enough optical loss at appropriate wavelengths to be partially transparent. Thus, in one embodiment, light emitted by optical emitters 320 in a cone-shaped pattern, reflects and is scattered off the diffusely reflective surfaces of the chambers present on the support member, thereby passing through the partially reflective member from the back to the front.

In embodiments of the present invention in which the reflective member is mounted adjacent to the front of the support member, the reflective nature of reflective member tends to partially trap light emitted from the optical emitters within a chamber. Thus, for example, light emitted into a given chamber 340 will diffusely reflect off the walls and bottom of the chamber, with a first portion of the light reflecting off the bottom of the reflective member and a second portion passing through the reflective member, wherein the second portion is a fraction of the first portion. Light reflected back into the chamber is reflected diffusely once again off the surfaces of the chamber, with a portion of this re-reflected light being incident on the reflective member (second pass) and passing through the reflective member. Thus, for the embodiment illustrated in FIG. 4B, light produced and diffusely reflected inside a given chamber 340 of the support member is generally confined to the given chamber until it passes through the reflective member, thus providing a source of back-lighting for images formed on the surface of the reflective member. Consequently, activation of the sensors 228 by motion of the elements 120 results in illumination through back-lighting of the images present at various locations on the reflective member.

Figure 4C:
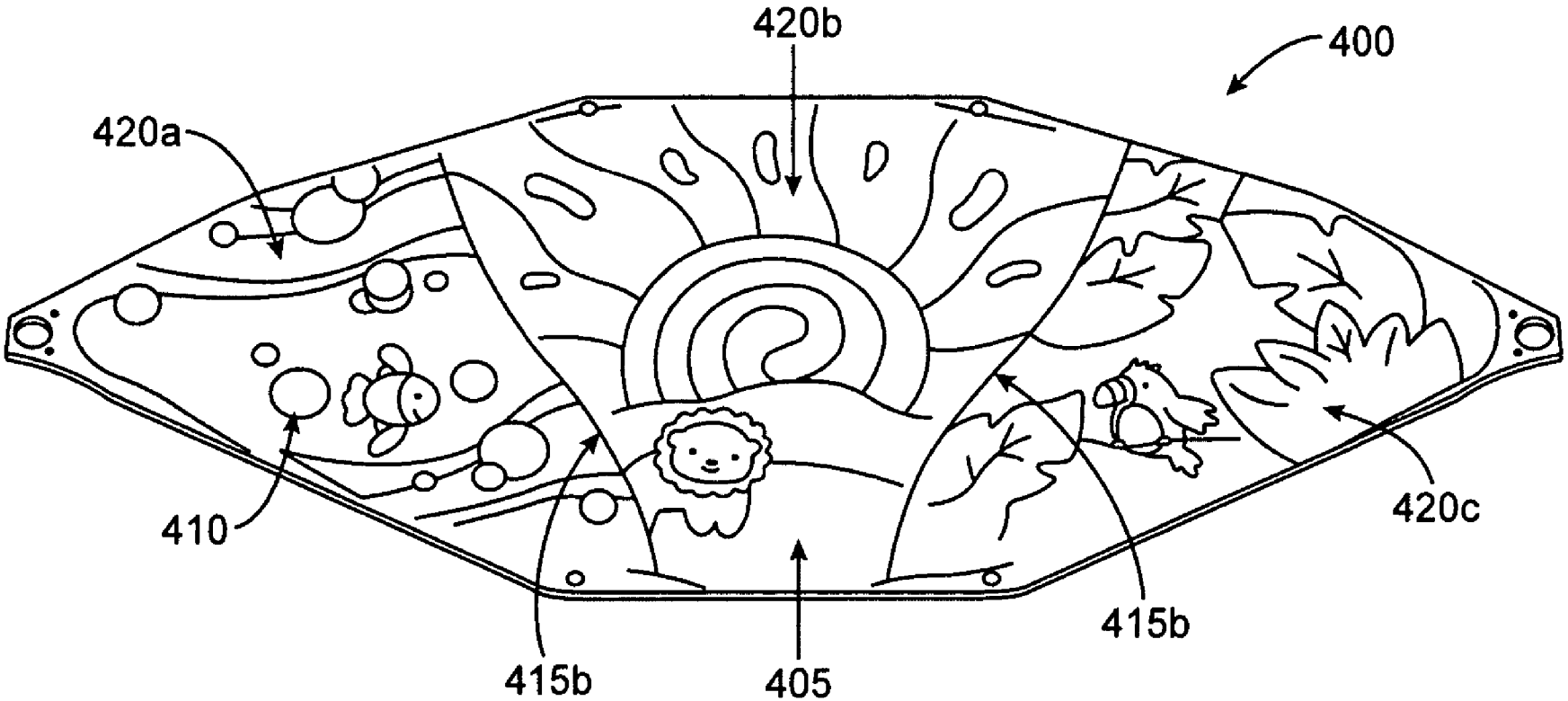
FIG. 4C is a simplified schematic illustration of a rear view of a reflective member according to an embodiment of the present invention.

FIG. 4C is a simplified schematic illustration of a rear view of a reflective member according to an embodiment of the present invention. As illustrated in FIG. 4C, reflective member 400 comprises both reflective 405 and opaque 410 sections (when viewed from the rear). In one embodiment, reflective member 400 is fabricated as a layered or laminate structure comprising a plastic substrate, a Mylar® film, and an printed acetate sheet. Printed elements on the acetate sheet produce opaque sections 410 on the reflective member. In one embodiment of the present invention, opaque regions 415 are positioned to align with generally vertical dividing walls 315 (illustrated in FIG. 3A). Thus, opaque regions 415 subdivide the reflective member into left, middle, and right regions, 420*a*, 420*b*, and 420*c*, respectively. Additionally, the dividing wall 317*b* in the shape of an arc (see FIG. 3A) is aligned to relate to the outline of the sun illustrated in the center of region 420*b*. In one embodiment, yellow light emitted from light emitting diode 320*c* produces a sunlight effect extending from approximately the center of region 330*b* toward the top of region 330*b*, thereby enhancing the image of the sun present on the reflective member.

Moreover, in a particular embodiment, opaque sections 410 are provided to produce images that correspond to the elements 120. For example, as illustrated in FIG. 4C, opaque sections of region 420*a* illustrate a fish in a water environment. This section 420*a* is located above and adjacent to the element 120*a* in the general shape of a blue fish. Moreover, opaque sections of regions 420*b* and 420*c* illustrate a lion on a savannah and a parrot in a forest, respectively. As with region 420*a*, regions 420*b* and 420*c* correspond to the elements representing a lion 120*b* and a parrot 120*c*, respectively.

Referring once again to FIG. 4B, this figure shows a front view of the reflective member 400 when the sensors associated with it are not activated. As shown, the reflective member 400 includes a mirror that allows an infant to see his or her image in it. When a sensor is activated, a predetermined image may "magically" appear before the infant. For example, referring to FIG. 4C, activation of the appropriate sensor will cause a light behind a lion image formed by opaque lines to light up, thus illuminating an image of a lion for the infant. Light passes through the reflective section 405 to the infant. In some embodiments, only the middle region 420*b* will illuminate when the sensor associated with that middle region is activated. The other regions 420*a*, 420*c* will also illuminate when sensors that are appropriate for those regions are activated. Accordingly, in one mode, the reflective member 400 acts as a mirror, while in another mode, the reflective member 400 acts as an interactive display.

As discussed previously, activation of sensors 228 by motion of elements 120 produces light and sound patterns in embodiments of the present invention. Moreover, in other embodiments, words, rhymes, and songs appropriate to the illustrations present on the reflective member 400 and the elements 120 are produced using speaker 215 under the control of control circuitry 220. Some embodiments provide coordination between the optical emitters and the words, rhymes, or songs. For example, in one embodiment, LEDs are illuminated in synchronization with the words in a rhyme that are related to the element batted or pulled by the infant. Specifically, batting of the bird element produces a rhyme related to the bird accompanied by illumination of the image of the bird present in region 420*c* in rhythm with the rhyme.

The combination of colored lights, images, and sounds produced by motion of the elements 120 in one embodiment of the present invention produces a learning environment for an infant seated in the infant bouncer. For example, in various modes of operation, every tap of an element results in the production of colorful images in the reflective member, introducing the infant to learning songs, words, and classical music that promote early language and future reading development, while encouraging gross motor skill development and tactile exploration. Multiple modes of operation allow a parent to vary the levels of the learning experience and stimulate the infant with a variety of play options.

Although embodiments of the present invention have related to production of light and sound resulting from motion of elements 120, this is not required by the present invention. Other embodiments utilize at least one sensor mounted below pad 125 to activate the interactive apparatus. In some embodiments in which the sensor is a kick-pad sensor, activation of the sensor produces light emission from the interactive apparatus in a "twinkling" mode. In alternative embodiments, twinkling of the optical emitters is accompanied by the production of sound. In other embodiments, a number of sensors are mounted below a moveable panel adjacent to pad 125, for example one senor mounted on a right portion of the moveable panel and one sensor mounted on a left portion of the moveable panel. Accordingly, an infant may activate the interactive apparatus by kicking with either the right or left foot, producing alternative series of lights and/or sounds depending on the nature of the kicking motion.

Embodiments according to the present invention incorporate a vibration feature into the infant bouncer. In one embodiment, a motor is mechanically coupled to the seat 105 and controlled by control circuitry 220. An unbalanced weight is attached to the shaft of the motor, producing vibrations upon operation of the motor. A vibration-mode toggle switch coupled to additional circuitry adapted to control the vibrational modes (not shown) provides control over a variety of vibrational modes. In a particular embodiment, there are three vibrational modes selectable through operation of the vibration-mode toggle switch, including a wave-like massage action of various intensities.

Figure 5A:
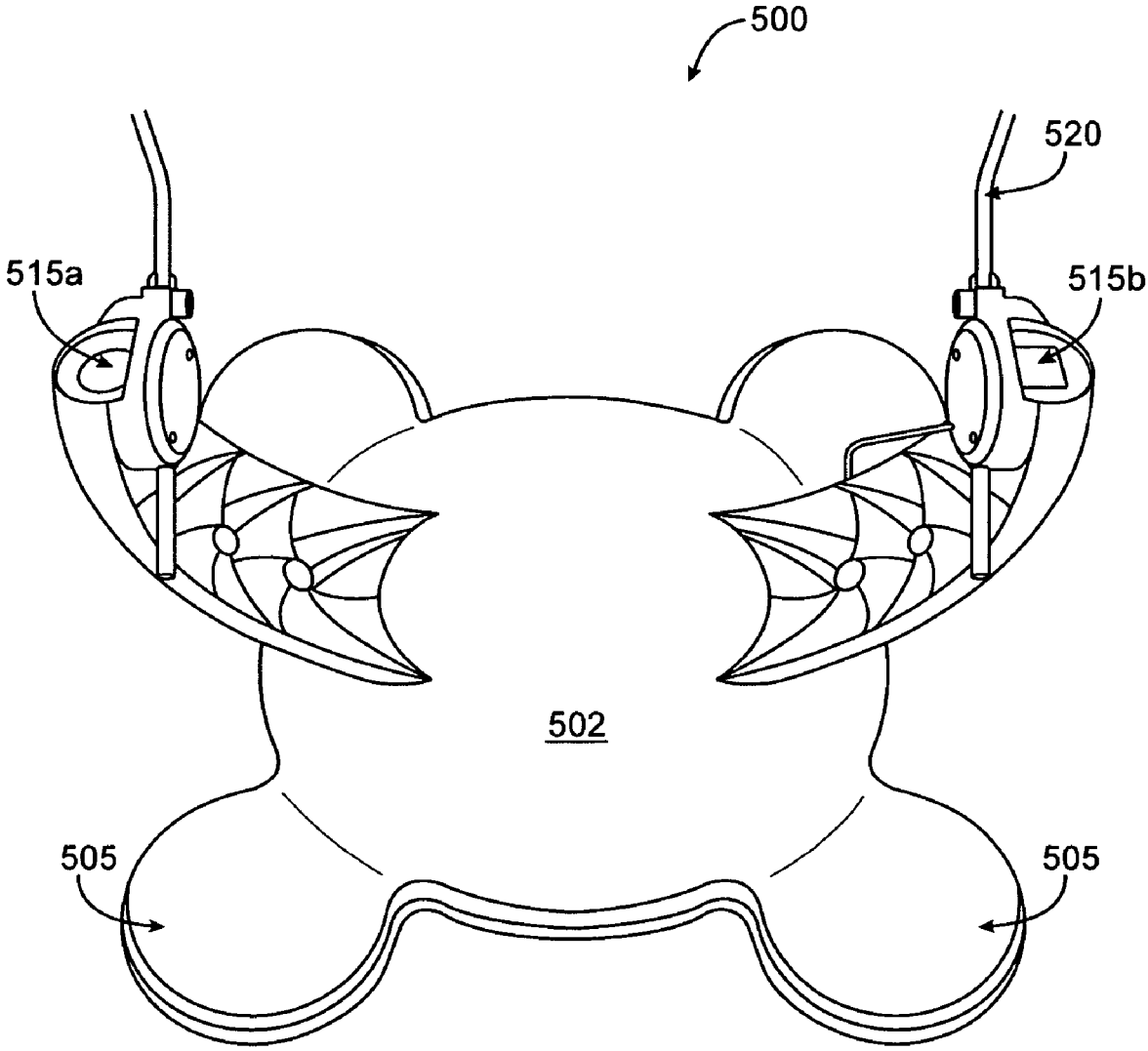
FIG. 5A is a simplified perspective illustration of a base for an interactive apparatus according to an embodiment of the present invention.

FIG. 5A is a simplified perspective illustration of a base for an interactive apparatus according to an embodiment of the present invention. Base 500 comprises a centrally located generally dome-shaped base member 502 surrounded by a number of smaller dome-shaped support members 505. In a particular embodiment, four support members 505 are disposed at a peripheral edge of base member 502. As illustrated in FIG. 5A, support members 505 provide lateral support while maintaining a low profile. In the embodiment according to the present invention illustrated in FIG. 5A, the base is fabricated from a high quality plastic characterized by mechanical rigidity and light weight.

Recessed features 515*a* and 515*b* are adapted to receive extension arms present on support arms 115*a* and 115*b* (see FIG. 1). As illustrated in FIG. 5A, recesses 515*a* and 515*b* utilize different cross-sections, circular, and square, respectively, to ensure that the interactive apparatus attached to the support arms is properly oriented. Metal frame 520, partially illustrated in FIG. 5A, provides support for the upper portion of seat 105 and is mechanically coupled to base 500. An additional metal frame, not shown, provides support for the lower portion of the seat, including the motor used for vibration of the seat.

Figure 5B:
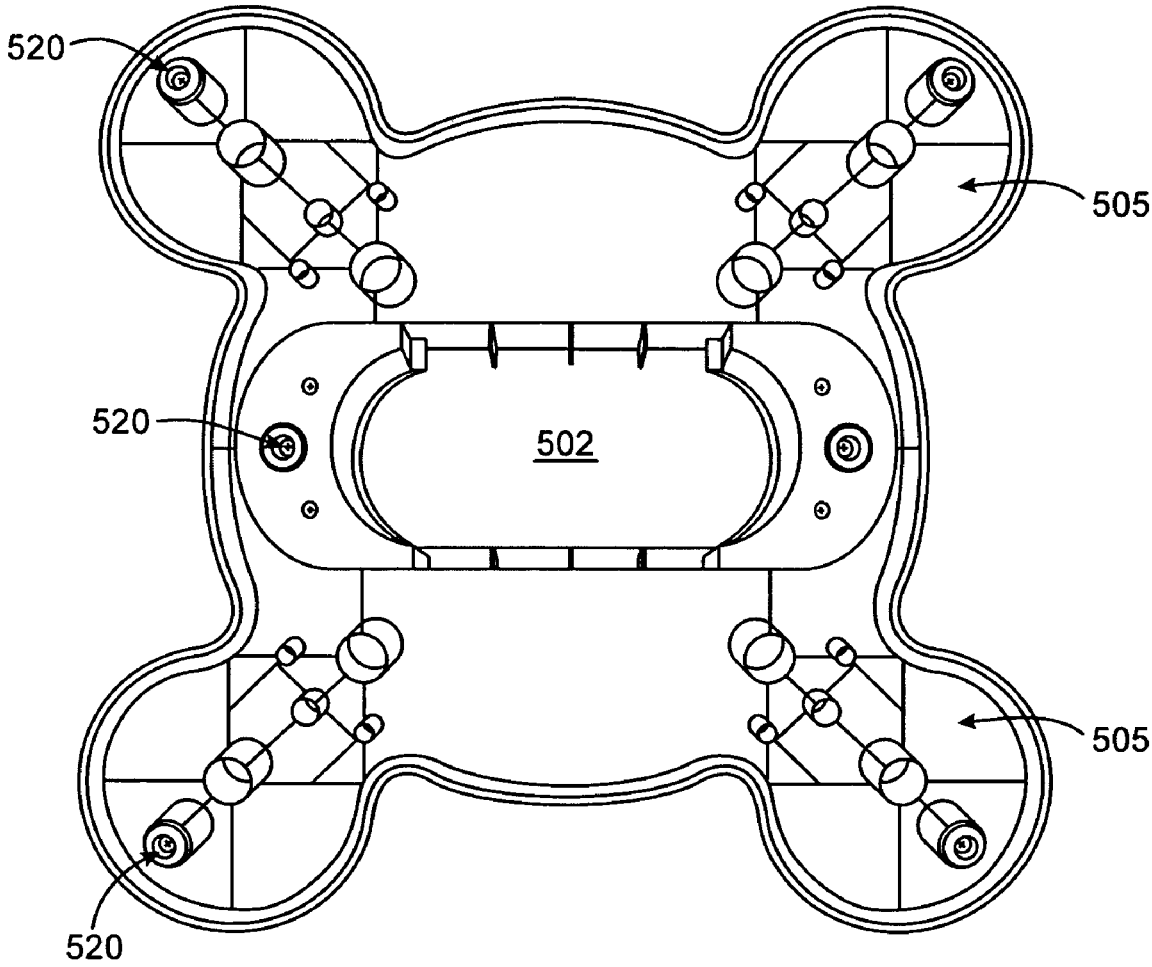
FIG. 5B is a simplified bottom-view illustration of a base for an interactive apparatus according to an embodiment of the present invention.

FIG. 5B is a simplified bottom-view illustration of a base for an interactive apparatus according to an embodiment of the present invention. Generally dome-shaped base member 502 is surrounded by a number of smaller dome-shaped support members 505. In one embodiment, the base member and the support members are manufactured as a single piece of material, but this is not required by the present invention. As illustrated in FIG. 5B, the four support members 505 are disposed at a peripheral edge of base member 502. Additionally, contact pads are coupled to an underside of the base. The wide stance provided by the laterally separated four support members increases the stability of the structure, preventing tipping of the structure. Moreover, in embodiments in which the contact pads are fabricated from materials different from the base member and supporting members, the differing material properties can be used to improve contact with the surface on which the base is placed. For example, in one embodiment the contact pads are fabricated from rubber with a non-skid surface, preventing sliding of the base across a solid surface, such as a wood floor or linoleum.

In one embodiment, the contact pads are flexible and are coupled to a number of positions on the base member, as well as a number of positions on the support members. The placement and dimensions of the contact pads can be selected to achieve a desired weight distribution profile and will be apparent to one of skill in the art. Moreover, the contact pads are located to make contact with a flat surface upon which the infant bouncer seat is placed. Other embodiments utilize contact strips to provide a non-skid surface with a desired weight distribution.

Figure 6B:
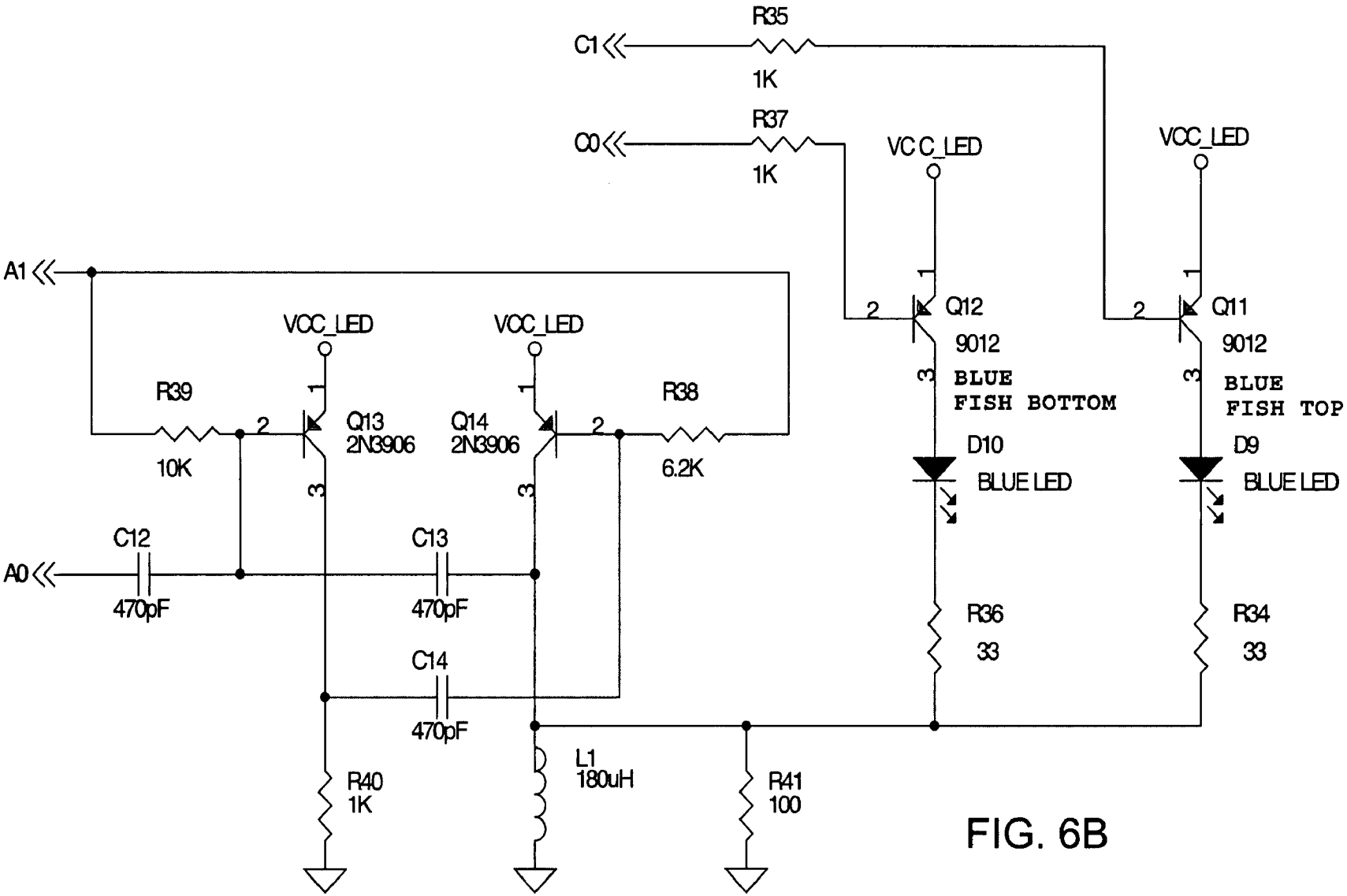

FIGS. 6A–6C are schematic diagrams of an electrical circuit for an interactive apparatus according to an embodiment of the present invention. FIGS. 6A and 6B illustrate control circuitry, including logic device labeled SPC500A2, that utilizes inputs from switches SW1, SW2, and SW3 to operate the LEDs as well as speaker SP1 present in the interactive apparatus. In FIGS. 6A and 6B, reference is made to locations such as "RED BIRD TOP" and "RED BIRD BOTTOM," previously referred to as chambers 340*c* and 340*d*. Control module 210 is partially represented by SW DP4T, providing for the various modes of operation previously discussed, including "MUSIC," "WORDPLAY," AND "RHYME." FIG. 6C illustrates control circuitry, including the logic device labeled SPC11A, that utilizes inputs from switches SW6 and SW7 to operate the vibrational features of the infant seat, including the motor M1. Vibration-mode toggle switch SW DP4T is used to select the various modes of operation for the vibrational features.

Figure 6D:
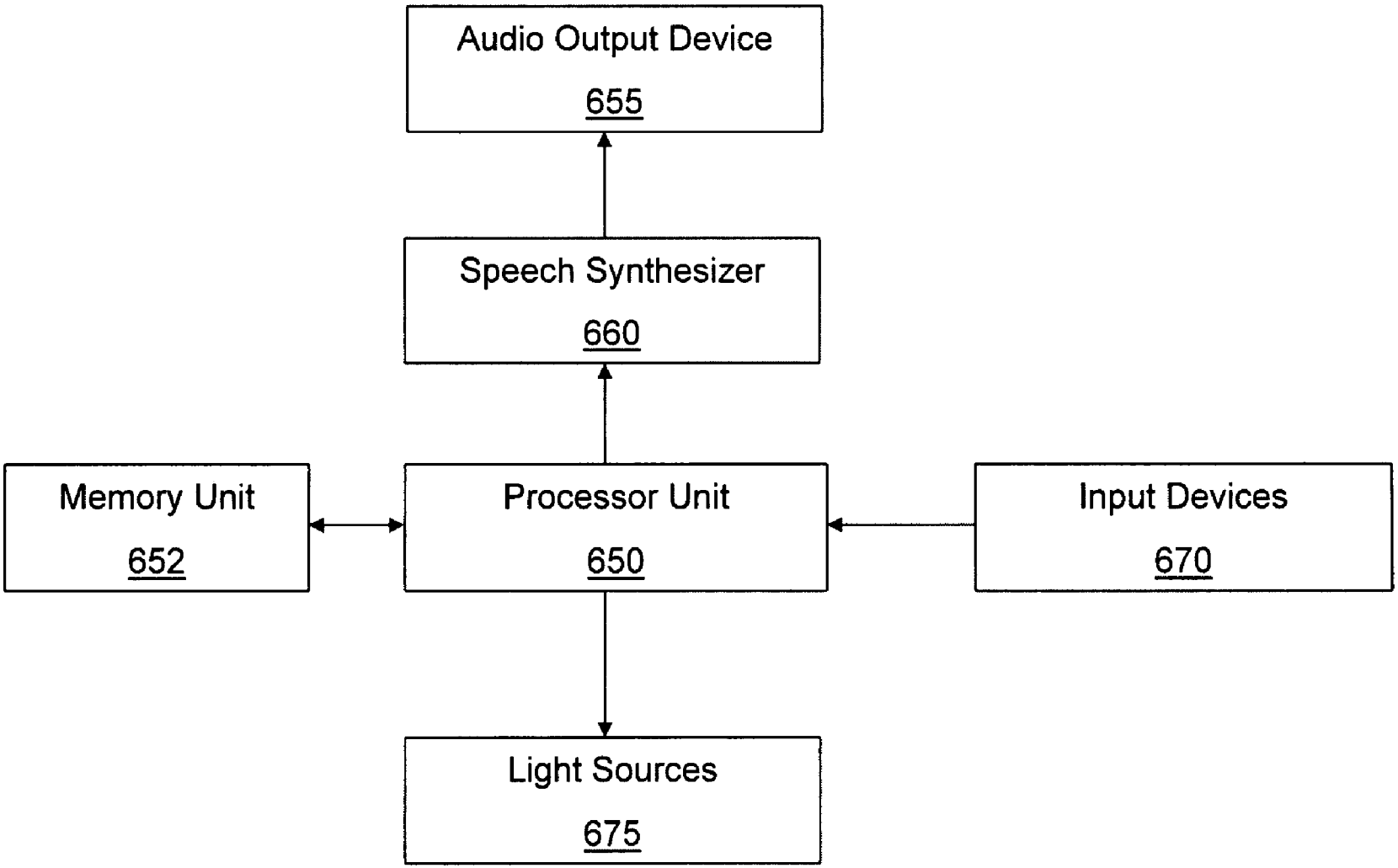
FIG. 6D is a simplified block diagram of an electrical circuit for an interactive apparatus according to an embodiment of the present invention.

FIG. 6D is a simplified block diagram of an electrical circuit for an interactive apparatus according to an embodiment of the present invention. In FIG. 6D, some electrical components of an embodiment of the invention are shown. The block diagram shows a processor unit 650, a memory unit 652 coupled to the processor unit 650, input devices 670 (e.g., elements 120 coupled to switches 228) coupled to the processor unit 650, a speech or sound synthesizer 660 coupled to the processor unit 650, and an audio output device 655 coupled to the processor unit 650. Light sources or optical emitters 675 are also coupled to the processor unit 650. Any of the functions described herein may be preprogrammed as computer code in the memory unit 652.

It is understood that any of the above described functions may be programmed into a memory device in or coupled to the above described apparatus by one of ordinary skill in the art, and that embodiments of the invention include apparatuses with memory devices that are preprogrammed to provide such functions.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

All references, patent applications, and patents mentioned above are herein incorporated by reference in their entirety for all purposes. None of them are admitted to be prior art to the presently claimed inventions.

What is claimed is:

1. An infant bouncer seat, comprising:

a seat inclined at a pre-determined angle with respect to the horizontal and adapted to support an infant in a semi-reclined position;

a base coupled to the seat, wherein the base comprises a generally dome-shaped base member and a plurality of smaller dome-shaped support members disposed at a peripheral edge of the generally dome-shaped base member;

an interactive mirror coupled to the seat, wherein the interactive mirror comprises a first image and a second image;

a first tactile element coupled to the interactive mirror; and a second tactile element coupled to the interactive mirror, wherein the first tactile element and the second tactile element are positioned within arms reach of an infant supported in a semi-reclined position by the seat.

2. The infant bouncer seat of claim 1, wherein motion of the first tactile element causes the first image to appear in the interactive mirror and motion of the second tactile element causes the second image to appear in the interactive mirror.

3. The infant bouncer seat of claim 1, wherein a plurality of flexible contact pads are coupled to an underside of the base.

4. The infant bouncer seat of claim 3, wherein the plurality of flexible contact pads are coupled to an underside of the generally dome-shaped base member and to an underside of the dome-shaped support members, the contact pads positioned to make contact with a flat surface upon which the infant bouncer seat is placed.

* * * * *